US005083909A

United States Patent [19]

Kunsemiller et al.

[11] Patent Number: 5,083,909

[45] Date of Patent: Jan. 28, 1992

[54] SEAWATER HYDRAULIC VANE TYPE PUMP

[75] Inventors: John P. Kunsemiller, Oxnard, Calif.; Robert R. Young, Cary, N.C.

[73] Assignee: The United States of America as represented by the Secretary of the Navy, Washington, D.C.

[21] Appl. No.: 620,506

[22] Filed: Nov. 29, 1990

[51] Int. Cl.[5] ..... F04C 2/344

[52] U.S. Cl. ..... 418/102; 418/179; 418/267; 403/359

[58] Field of Search ..... 418/102, 268, 267, 179, 418/181; 403/359

[56] References Cited

U.S. PATENT DOCUMENTS

| | | | |
|---|---|---|---|
| 1,689,730 | 10/1928 | Knight | 403/359 |
| 1,898,914 | 2/1933 | Vickers | 418/268 |
| 2,357,333 | 9/1944 | Kendrick et al. | 418/267 |
| 2,632,398 | 3/1953 | Ferris | 418/267 |
| 2,641,195 | 6/1953 | Ferris | 418/267 |
| 2,861,517 | 11/1958 | Neff . | |
| 2,998,783 | 9/1961 | Lee | 418/102 |
| 3,211,104 | 10/1965 | Rosaen | 418/268 |
| 3,254,606 | 6/1966 | Rosaen | 418/268 |
| 3,632,238 | 1/1972 | Searle | 418/15 |
| 3,820,924 | 6/1974 | Cassidy | 418/89 |
| 3,869,231 | 3/1975 | Adams | 418/267 |
| 4,009,973 | 3/1977 | Heinrich | 418/267 |
| 4,259,044 | 3/1981 | Drutchas et al. | 418/267 |
| 4,376,620 | 3/1983 | Colston | 418/102 |
| 4,827,800 | 5/1989 | Pedersen et al. | 403/359 |
| 4,932,809 | 6/1990 | Kopp | 403/359 |

OTHER PUBLICATIONS

Navy Technical Disclosure Bulletin vol. 12, No. 2, Dec. 1986 pp. 27-32. "Undervane Pressurization System For Hydraulically Balanced Vane Pumps and Motors".

*Primary Examiner*—Richard A. Bertsch
*Assistant Examiner*—David L. Cavanaugh
*Attorney, Agent, or Firm*—David S. Kalmbaugh

[57] ABSTRACT

A vane type hydraulic energy translating device for pumping filtered seawater and which uses seawater as a lubricating fluid. The pump is a compact, light weight design in which the bearings and certain other critical components are fabricated from corrosion resistant, low friction, high strength materials. The vanes as well as flexible side plate members are formed of these corrosion resistant materials. The pump body is formed of high corrosion resistant stainless steel. The side plates are flexible and act as wear surfaces for the ends of the vanes as well as sealing surfaces about the rotor thereby preventing leakage of seawater from high to low pressure areas. Each vane is spring biased radially outward from the rotor axis with four springs disposed within apertures located in the vane base. The vanes are generally rectangular in shape and have an outer end portion which serves as a sliding seal against a cam ring track. The rotor of the pump is uniquely splined to the shaft such that axial forces along the shaft do not translate to the rotor. A unique under vane pressurization system facilitates the passage of pressurized seawater to the base of the vane to assist in urging the vane radially outward against the cam track ring.

8 Claims, 5 Drawing Sheets

SEAWATER HYDRAULIC VANE TYPE PUMP

BACKGROUND OF THE INVENTION

1. Field of the Invention

The present invention relates generally to hydraulics and more particularly to a fluid pressure energy translating device of the vane type designed to pump filtered seawater and use filtered seawater as the lubricating fluid. The seawater hydraulic vane type pump of the present invention is designed for underwater usage by providing pressure for actuating various operating components.

2. Description of the Prior Art

The design of a vane type fluid pressure energy translating device for underwater usage which pumps filtered seawater and uses filtered seawater as a lubricant presents a serious challenge to the designer because of the general corrosiveness of seawater on the precision made parts of such pumps. The poor lubricity of seawater and a much lower viscosity for seawater than for conventional oil hydraulic fluid contributes to the problem. The generally lower viscosity which seawater exhibits means that all design clearances must be an order of magnitude less than for prior art oil lubricated fluid pressure energy translating devices. In addition, potential leakage of an oil lubricant from the pump which might contaminate the underwater environment requires that no oils or greases be used.

A prior art energy translating device which utilized filtered pressurized seawater as the operating and lubricating fluid is disclosed in U.S. Pat. No. 4,376,620, entitled "Seawater Hydraulic Vane Type Motor" to John R. Colston. This vane type motor disclosed therein uses spring loaded rectangular shaped vanes having an arcuate outer end portion which serves as a sliding seal against a cam ring track. The vane members have side faces normal to the direction of rotor rotation, which side faces include grooves which extend along the entire opposed side face extent in a direction normal to the direction of rotation. A radially extending slot extends from the groove to the base of the vane to facilitate passage of pressurized seawater to the base of the vane to assist in urging the vane radially outward against the cam ring track. While this prior art energy translating device performs satisfactorily for its intended purpose as a power source for seawater hydraulic tools such as the band saw of U.S. Pat. No. 4,953,295, there are certain limitations in the design of this prior art energy translating device which prevent it from performing satisfactorily as a seawater pump.

Thus, it is an object of the present invention to provide an energy translating device which will function as an apparatus for pumping filtered seawater and use the filtered seawater as a lubricant.

It is a further object of the present invention to provide a seawater hydraulic vane type pump which is resistant to the corrosive effects of seawater.

It is still another object of the present invention to provide a lightweight, compact, highly efficient seawater hydraulic vane type pump.

These and other objects of the invention will become more apparent to those skilled in the art by reference to the detailed description of the present invention when viewed in light of the accompanying drawings.

SUMMARY OF THE INVENTION

A vane type hydraulic energy translating device for pumping filtered seawater has been provided in a compact, light weight design in which the bearings and certain other critical components are fabricated from corrosion resistant, low friction, high strength materials. The vanes as well as flexible side plate members are formed of these corrosion resistant materials. The pump body is formed of high corrosion resistant stainless steel.

The side plates are flexible and act as wear surfaces for the ends of the vanes as well as sealing surfaces about the rotor thereby preventing leakage of seawater from high to low pressure areas. Each vane is spring biased radially outward from the rotor axis with four springs disposed within apertures located in the vane base. The vanes are generally rectangular in shape and have an outer end portion which serves as a sliding seal against a cam ring track. The rotor of the pump is uniquely splined to the shaft such that axial forces along the shaft do not translate to the rotor. A unique under vane pressurization system facilitates the passage of pressurized seawater to the base of the vane to assist in urging the vane radially outward against the cam track ring.

DESCRIPTION OF THE PREFERRED EMBODIMENT

Figure 1:
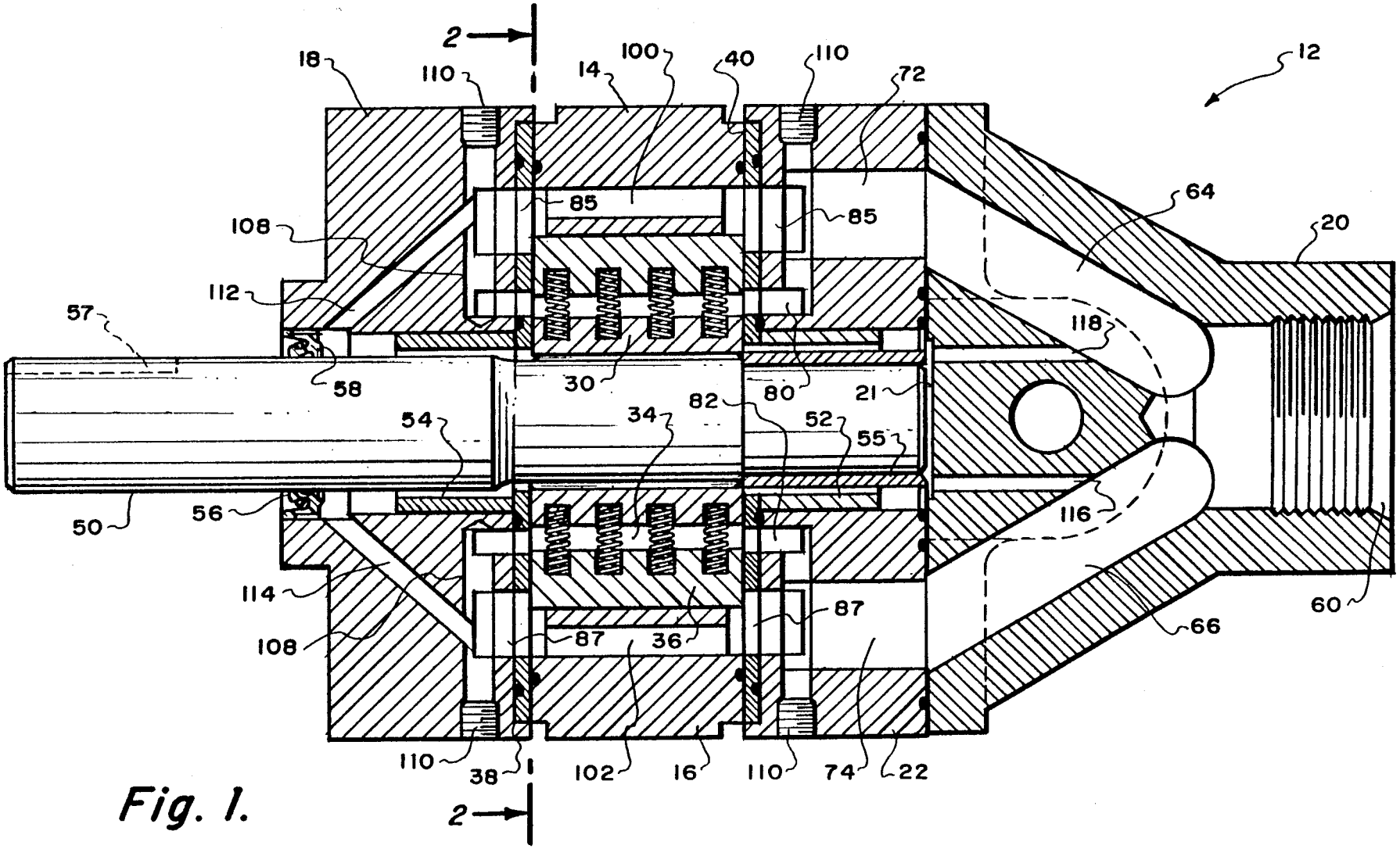
FIG. 1 is a side view in section of the seawater hydraulic vane type pump constituting the present invention.
Figure 2:
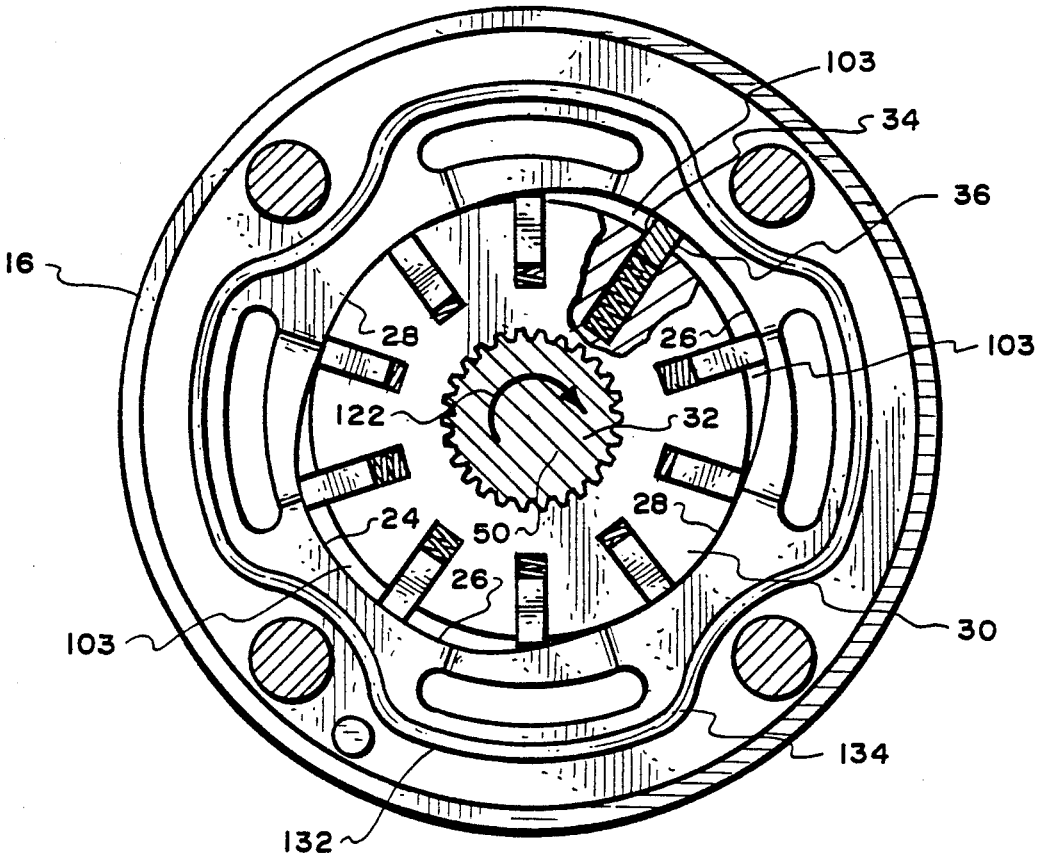
FIG. 2 is a view taken along line 2—2 of FIG. 1 looking toward the cam ring track and the rotor of the hydraulic pump.
Figure 3:
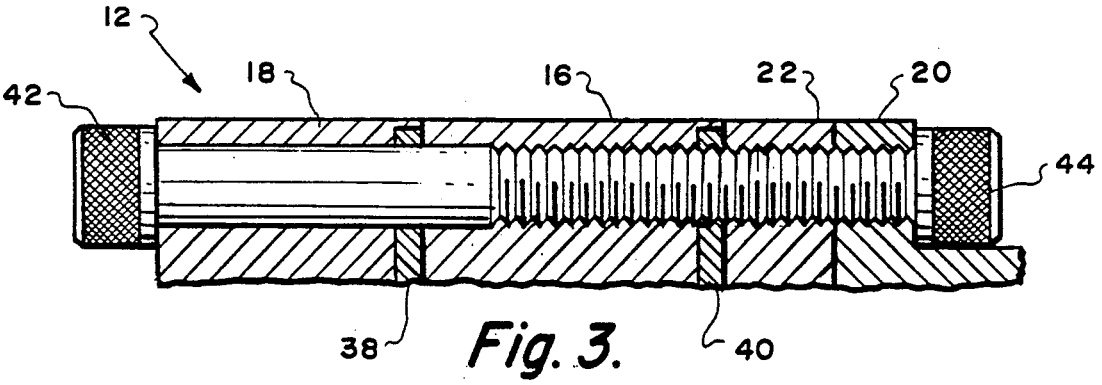
FIG. 3 is a partial sectional view in section illustrating the use of threaded bolts to join the housing components of the seawater hydraulic pump.

Referring first to FIGS. 1 and 2, the seawater hydraulic pump 12 of the present invention comprises housing 14 formed by a centralized ring member or rotor housing 16, a pair of end housings 18 and 22 with end housing 18 being disposed on one side and end housing 22 being disposed on the opposite side of rotor housing 16, and a port housing 20 fastened to end housing 22. A shaft receiving opening 21 extends axially and centrally through pump housing 14 to port housing 20 as is best illustrated in FIG. 1. Rotor housing 16 has a cam ring track interior surface 24 with a major diameter portion 26 and a minor diameter portion 28. A rotor 30 is disposed within ring 24 and has a central opening 32. A plurality of circumferentially spaced slots 34 are provided in the perimeter of the rotor 30 and accept rectangular shaped vanes 36. A pair of flexible side plates 38 and 40 are disposed on either side of rotor 30 in sliding sealed relationship with rotor 30. As is best illustrated in FIG. 3, the housing components of pump 12 are joined in axially spaced relationship by a plurality of threaded bolts 42 which extend through housings 16 and 18 and side plates 38 and 40 and threadably engage housing 22 and a plurality of threaded bolts 44 which extend through housing 20 and threadably engage housing 22.

Figure 4:
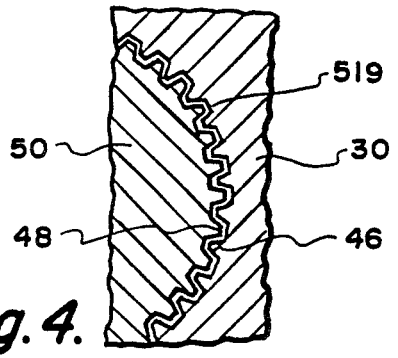
FIG. 4 is a partial end view illustrating the mating of the shaft with the rotor of the seawater hydraulic pump.
Figure 5:
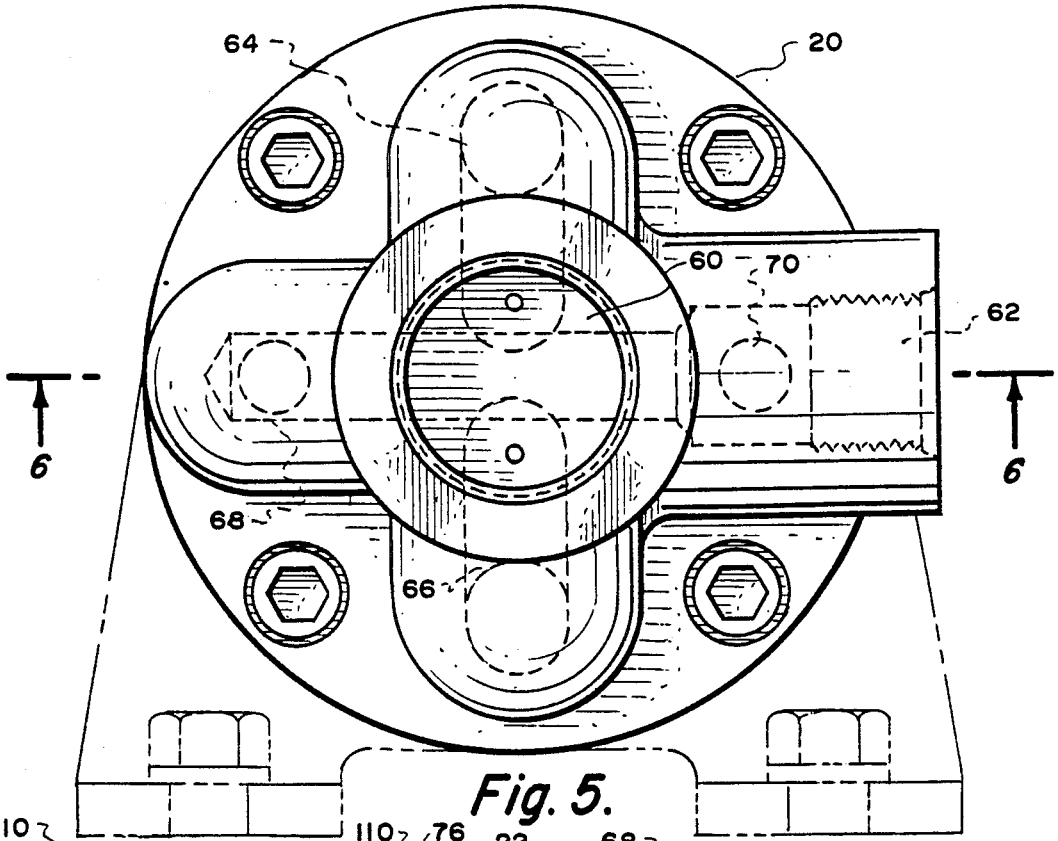
FIG. 5 is an end view of the seawater hydraulic pump.
Figure 6:
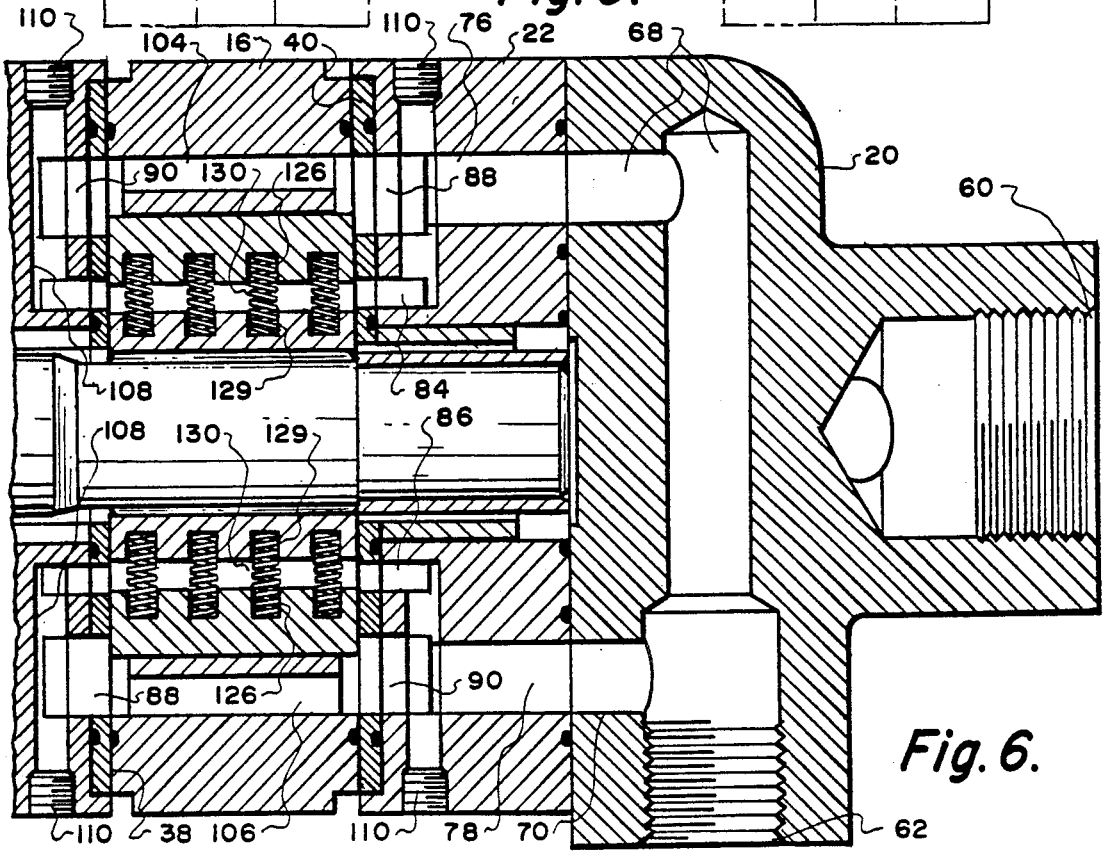
FIG. 6 is a partial sectional view taken along line 6—6 of FIG. 5 of the seawater hydraulic pump.

Referring now to FIGS. 1, 2, 3 and 4, the central opening 32 of the rotor 30 coincides with and is axially aligned with the opening 21 within pump housing 14 and is provided with axially extending spline 46 which mates with and drivingly engages the spline 48 on a shaft 50. Shaft 50 is journaled in a pair of bearings 52 and 54 mounted within shaft receiving opening 21 on each side of rotor 30. Bearings 52 and 54, in turn, provide rotational support for shaft 50. The end portion of shaft 50 extending from pump housing 14 is provided with a key 57 which allows for the coupling of pump 12 to a motor, not shown. The opposite end of shaft 50 is stepped to allow a sleeve 55 to be press fitted thereon with the sleeve 55 abutting one side of rotor 30 as is best illustrated in FIG. 1. A shaft seal 56 is disposed within opening 21 between shaft 50 and the inner cylindrical surface 58 of end housing 18. Shaft seal 56, in turn, prevents leakage of unfiltered seawater along shaft 50 when pump 12 is being utilized in an underwater environment and also prevents leakage of air along shaft 50 when pump 12 is being utilized in an open air environment. As is best illustrated in FIG. 4, there is a gap 59 between the axially extending spline 46 of rotor 30 and the spline 48 of shaft 50. Gap 59 is narrow thereby allowing shaft 50 to engage rotor 30 while allowing for slight angular movement of shaft 50 within opening 21 without translating to rotor 30 the axial forces created by the angular movement of shaft 50. Thus, gap 50 allows rotor 30 to remain in axial alignment with opening 21.

The fluid flow circuit for pump 12 can best be described with reference to FIGS. 1, 5, 6 and 7. Port housing 20 has an inlet port 60 disposed in axial alignment with opening 21, an outlet port 62 disposed angularly ninety degrees from the inlet port 60, a pair of slanted passage ways 64 and 66 which communicate with inlet port 60, an L shaped passage way 68 which communicates with outlet port 62 and an axial passage way 70 which communicates with outlet port 62. End housing 22, in turn, has four axial passage ways 72, 74, 76 and 78 which respectively communicate with passage ways 64, 66, 68 and 70 and four L shaped passage ways 80, 82, 84 and 86 respectively communicating with passage ways 72, 74, 76 and 78.

Figure 7:
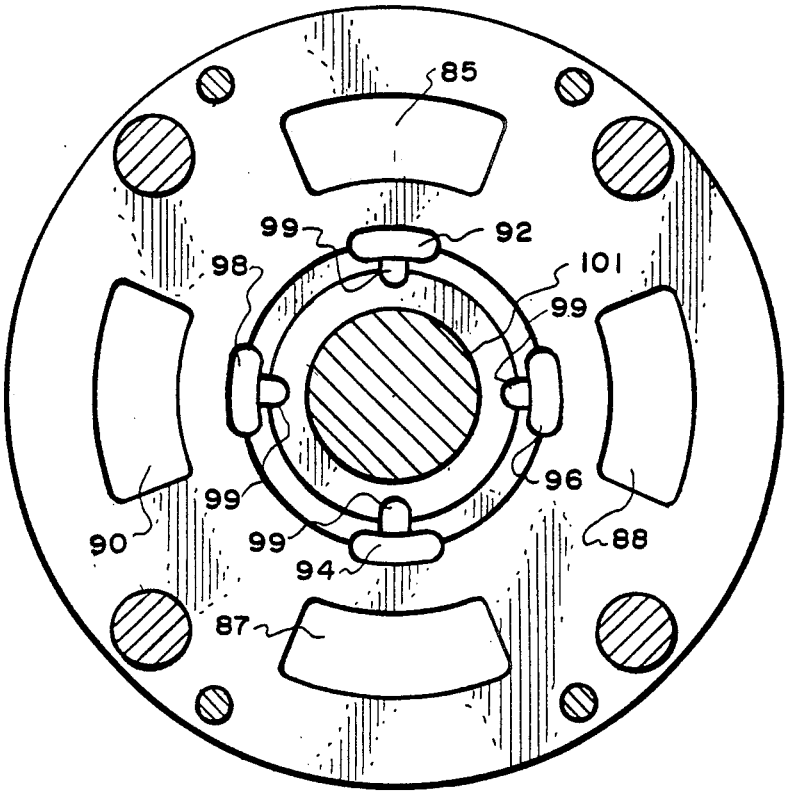
FIG. 7 is a side elevational view of a side plate as seen from the side facing the rotor of the seawater hydraulic pump.

Referring to FIG. 7, each side plate 38 and 40 is provided with a pair of diametrically opposed inlet ports 85 and 87, a pair of diametrically opposed outlet ports 88 and 90 angularly displaced ninety degrees from the inlet ports 85 and 87, four vane ports 92, 94, 96 and 98 and four indents 99 with each of the indents 99 extending from one of the vane ports. The indents 99 provide for cooling of the side plate between the vane ports and opening 101 when pump 12 is operational. The four vane ports 92, 94, 96 and 98 are respectively aligned with ports 85, 87, 88 and 90 as is best illustrated in FIG. 7. The inlet ports 85 and 87 and the outlet ports 88 and 90 in flexible side plates 38 and 40 communicate with the space 103, FIG. 2, between rotor 30 and cam ring track 24. The vane ports 92, 94, 96 and 98 align with the base of the slots 34 to allow filtered seawater to be admitted to and withdrawn from the base of each vane 36 while the vane 36 rotates so that the seawater can act to radially force each vane 36 outward against cam ring track 24.

Referring again to FIGS. 1, 5, 6 and 7, the four axial passage ways 72, 74, 76 and 78 of housing 22 respectively communicate with ports 85, 87, 80 and 90 of plate 40 which, in turn, respectively communicate with four axial passage ways 100, 102, 104 and 106 disposed in rotor-housing 16. The axial passage ways 100, 102, 104 and 106 are, in turn, respectively aligned with the ports 85, 87, 90 and 88 of side plate 38. End housing 18 is provided four radial passage ways 108 with each of the four radial passage ways 108 connecting a vane port with its aligned inlet or outlet port. Each of the radial passage ways 108 in housing 18 and each of the radial passage ways 80, 82, 84 and 86 in housing 22 are provided with a plug 110 which prevents filtered seawater from exiting pump 12 through radial passage ways 108 and radial passage ways 80, 82, 84 and 86.

Referring to FIG. 1, end housing 18 has a pair of slanted passage ways 112 and 114 which allow filtered seawater to flow to and lubricate bearing 54 with passage way 112 providing a fluid flow path between inlet port 85 of side plate 38 and opening 21 and passage way 114 providing a fluid flow path between inlet port 87 of side plate 38 and opening 21. Similarly, port housing 20 has a pair of axial passage ways 116 and 118 which allow filtered seawater to flow to and lubricate bearing 52 with passage way 116 providing a fluid flow path between passage way 66 and opening 21 and passage way 118 providing a fluid flow path between passage way 64 and opening 21.

Figure 11:
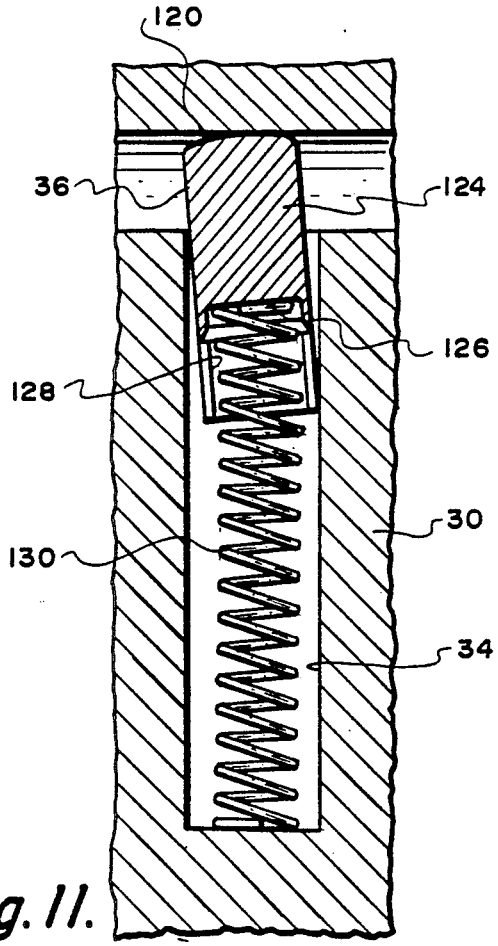
FIG. 11 is a schematic illustration of one of the vanes in a rotor slot at a position along the ring track where the high pressure seawater is acting against the vane while the rotor is rotating.

Referring now to FIGS. 1, 2, 9, 10 and 11, the vane members 36 have an arcuate outer end portion 120 which serves as a sliding seal against the eccentric or cam ring track 24 as the rotor 30 and vanes 36 rotate in the direction indicated by the arrow 122, FIG. 2. The vanes 36 are generally rectangular in configuration and have larger area side faces 124 upon which the filtered seawater is directed. Each vane 36 is provided with four spring apertures 126 and four radially extending slots 128 in each vane side face 124 with each radial extending slot 128 extending from slightly above the base of spring aperture 126 to the base of vane 36. Each radially extending slot 128 is aligned with and leads into one of four spring apertures 126 provided in the base of vane 36. Each circumferentially spaced slots 34 in the perimeter of the rotor 30 has extending therefrom four spring apertures 129 which align with the spring apertures 126 in the base of vane 36. Four springs 130 fit within the apertures 129 and the aligned apertures 136. The four springs 130 act along with the filtered seawater admitted to and withdrawn from the base of each vane 36 to maintain the arcuate outer end portion 120 of each vane 36 in sealed engagement against the eccentric or cam ring track 24 while the vanes rotate. As is best illustrated in FIG. 11 high pressure filtered seawater acts on the vane side face 124 to cock it and open a gap between the vane 36 and the slot 34 of rotor 30 to allow high pressure fluid to flow to the vane base via the radial slots 128, FIG. 9. The radial slots 128, FIG. 9, ensure fluid flow when the vane is extended radially outward without requiring a large gap between vane 36 and slot 34. A large gap would cause vane "face slap" and generally erratic operation and shortened lifetime for the pump. The high pressure seawater having access via the radial slots 128 to the base of vane 36 acts along with springs 130 and the filtered seawater admitted to and withdrawn from the base of vane 36 to maintain the arcuate outer end portion 120 of each vane 36 in sealed engagement against cam ring track 24 while the vane rotates.

Referring to FIGS. 1, 2, 6 and 7 rotation of rotor 30 in the direction of arrow 122 draws filtered seawater through inlet ports 85 and 87 into the space 103 between rotor 30 and cam ring track 24. The vanes 36 accelerate the filtered seawater producing an increase in pressure to approximately 1400 pounds per square inch at the outlet ports 88 and 90. At the same time filtered seawater is drain through inlet ports 85 and 87 low pressure filtered seawater enters slot 34 below the base of vane 36 through vane ports 92 and 94 acting upon the base of vane 36 to maintain the arcuate outer end portion 120 of each vane 36 in sealed engagement against or cam ring track 24. The filtered seawater then exits slot 34 through vane ports 96 and 98 at increase in pressure at the same time that high pressure seawater exits outlet ports 88 and 90.

Figure 8:
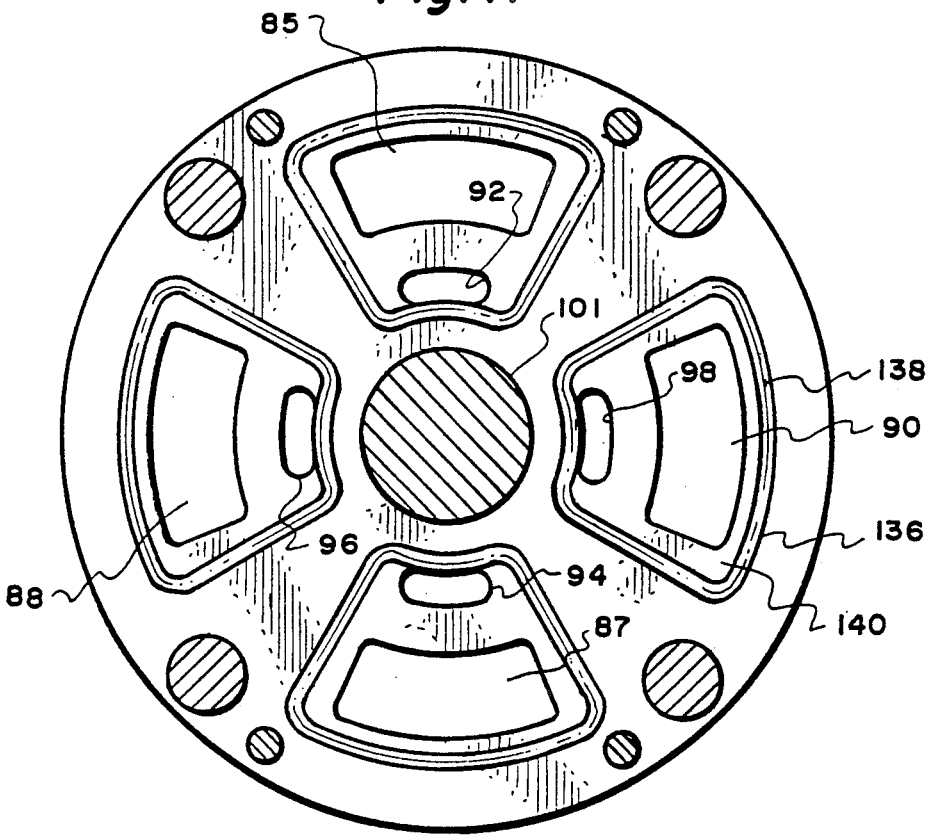
FIG. 8 is a side elevational view of the opposite side the side plate of FIG. 7.
Figure 9:
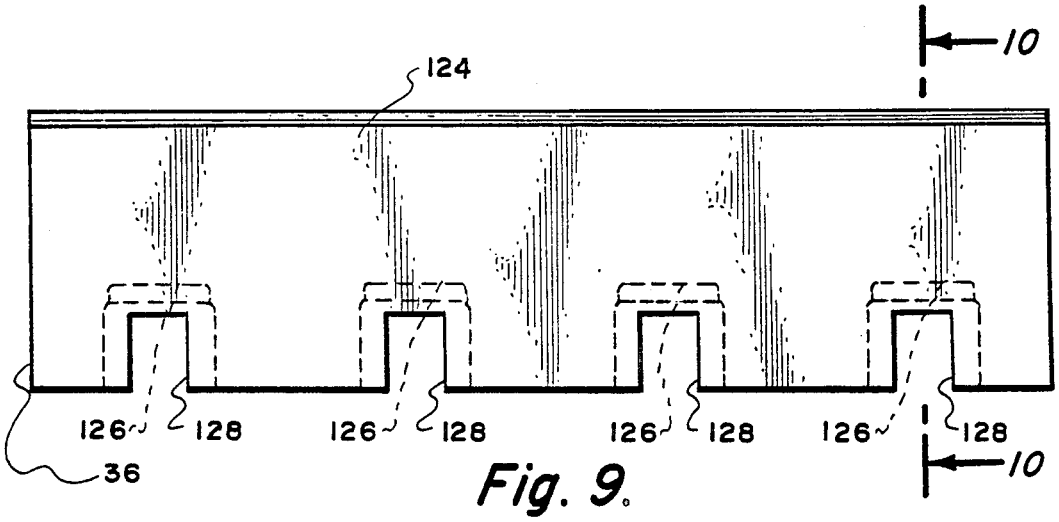
FIG. 9 is a side elevational view enlarged showing the vane structure used in the present invention.
Figure 10:
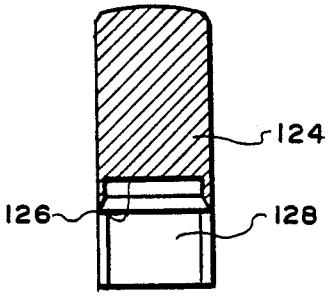
FIG. 10 is a sectional view of the vane of FIG. 9 taken along the line 10—10 of FIG. 9.

Referring to FIGS. 2 and 8, to facilitate sealing of the pump 12 to insure that the filtered seawater is transferred with the rotated vanes 36, an annular O-ring receiving channel 132 is provided in each of the side faces of the cam ring track 24 with a suitable annular O-ring 134 seated therein and sealed against the flexible side plates 38 and 40 when the pump 12 is assembled. As best seen in FIG. 8, an O-ring channel 136 and an O-ring 138 is provided about each of the inlet ports 85 and 87 and outlet ports 88 and 90 on the face of side plate 38 which abuts end housing 18 and the face of side plate 40 which abuts end housing 22. The O-ring channels 136 are provided about generally fan shaped pressure pad areas 140 on the face of each side plates 38 and 40, which pressure pad areas are dimensioned to provide a pressure balance on the side plates 38 and 40 and the rotor 30.

The bearing material which forms the vanes 36, side plates 38 and 40, and axial bearings 52 and 54 has high strength, low friction coefficients to exhibit acceptable wear rates during operation and is corrosion resistant. The material selected for the vanes and side plates, Torlon 4347 a wear resistant polymer manufactured by Amoco Chemical Corporation, exhibits about a 1% linear expansion when immersed in seawater for one month and its thermal coefficient of expansion is such that no problem of seizing of pump parts has been experienced. This material has high flexibility which combined with the inlet pressure pad areas 140 designed into each side plate 38 and 40 about the inlet and outlet ports thereof, and the O-rings 138 about these pressure pad areas 140 between the side plates 38 and 40 and housings 18 and 22 provides reliable seals. The pressure pad areas 140 are shaped to result in an approximate pressure balance between the pressure on both sides of each side plate 38 and 40. The O-rings 138 act as static seals for inlet and outlet flow passages. The material selected for the axial bearings 52 and 54 was Rulon, a polymer bearing material developed by Dixon Industries Corporation which exhibits high strength and low friction coefficient to provide acceptable wear rates during operation and is corrosion resistant. The O-rings utilized are conventional O-rings of Neoprene. The other pump components were fabricated from Inconel 718 which is a nickel alloy steel and Ferralium 255 which is a stainless steel. The Inconel members include the rotor 30, the cam ring track 24, and the shaft 50 and shaft sleeve 54 which are integral with rotor 30. The bolts 42 and 44 which hold the pump together as well as the end housings 18 and 22 and the port housing 20 were fabricated from stainless steel.

In summary, a light weight durable seawater hydraulic pump has ben developed. The seawater pump developed is rated at 10 horsepower and will provide a pressure of 1400 pounds per square inch at the rated horsepower.

What we claim is:

1. A vane type energy translating device for pumping filtered seawater and which uses filtered seawater as a lubricating fluid, said vane type energy translating device comprising:

a rotor housing having a cam ring track interior surface with a major diameter portion and a minor diameter portion and four axial passage ways angularly displaced ninety degrees apart within said rotor;

a rotor disposed within said cam ring track interior surface, said rotor having a central axial opening and a plurality of spaced apart circumferential slots in the perimeter thereof, the central axial opening of said rotor having an axial extending spline and the circumferential slots of said rotor each having at least four spring receiving apertures extending therefrom;

a central axial extending shaft having a spline which mates with and drivingly engages the spline of said rotor;

a narrow gap between the spline of said rotor and the spline of said shaft, said gap allowing said shaft to remain engaged with said rotor while allowing for angular movement of said shaft without translating to said rotor the axial forces created by the angular movement of said shaft;

a plurality of spring loaded vanes disposed in the circumferential slots of said rotor, each of said vanes being biased outward against said cam ring track in sliding seal relationship to said cam ring track and being generally rectangularly shaped with a base and an arcuate outer end portion which serves as a sliding seal against said cam ring track, the base of each vane having at least four spring receiving apertures with each spring receiving aperture being aligned with one of the spring receiving apertures of said circumferential slots;

a plurality of springs with each of said springs being disposed within one of the spring receiving apertures of the base of said vanes and the aligned spring receiving aperture of said circumferential slots, said springs moving the vanes outward against said cam ring track to maintain the arcuate outer end portion of each vane in sliding seal relationship to said cam ring track;

first and second side plates disposed on either side of said rotor housing and said rotor in sliding sealed relationship with said rotor, each of said side plates having a pair of diametrically opposed inlet ports and a pair of diametrically opposed outlet ports with each of said inlet or outlet ports aligning with one of the axial passage ways of said rotor housing, four vane ports with each of said vane ports being in radial alignment with one of the inlet or outlet ports of said side plate and four indents with each indent facing said rotor and extending from one of said four vane ports;

a first end housing disposed on one side of said rotor housing and sealable to the first of said side plates, said first end housing having four radial passage ways with each of said radial passage ways connecting one of the vane ports to the aligned inlet or outlet port of said first side plate, and an opening through which said shaft extends;

a second end housing disposed on the other side of said rotor housing and sealable to the second of said side plates, said second end housing having four radial passage ways with each of said radial passage ways connecting one of the vane ports to the aligned inlet or outlet port of said second side plate, two axial inlet passage ways with each axial inlet passage way communicating with one of the inlet ports of said second side plate, two axial outlet passage ways with each axial outlet passage way communicating with one of the outlet ports of said second side plate and an opening through which said shaft extends; and a port housing disposed on the side of said second end housing opposite said second side plate in sealed engagement with said second end housing, said port housing having an inlet port, an outlet port, a pair of slanted passage ways with each of said slanted passage ways connecting one of the inlet axial passage ways of said second end housing to the inlet port of said port housing, an L shaped passage way connecting one of the axial outlet passage ways of said second end housing to the outlet port of said port housing and an axial passage way connecting the other of the axial outlet passage ways of said second end housing to the outlet port of said port housing.

2. The vane type energy translating device of claim 1 further characterized by a first bearing disposed within the opening in said first end housing and a second bearing disposed within the opening in said second end housing, said bearings having said shaft journaled therein so as to allow for the rotation of said shaft.

3. The vane type energy translating device of claim 2 wherein said bearings are fabricated from a corrosion resistant polymer bearing material having high strength and a low friction coefficient.

4. The vane type energy translating device of claim 1 further characterized a pair of slanted passage ways disposed within said first end housing for connecting the inlet ports of said first side plate to the opening within said first end housing and a pair of axial passage ways disposed within said port housing for connecting the slanted passage ways within said port housing to the opening within said second end housing.

5. The vane type energy translating device of claim 1 wherein said vanes and said side plates are fabricated from a wear resistant polymer.

6. The vane type energy translating device of claim 1 wherein said rotor and said shaft are fabricated from a nickel alloy steel.

7. The vane type energy translating device of claim 1 wherein said end housings and said port housing are fabricated from stainless steel.

8. The vane type energy translating device of claim 1 wherein said vane ports are positioned within said side plates so as to allow filtered seawater to be introduced into the space between the base of each vane and the slot within which the vane is disposed when the vane transitions from the minor diameter to the major diameter portion of said cam ring track and to allow filtered seawater to exit from the space between the base of each vane and the slot within which the vane is disposed when the vane transitions from the major diameter to the minor diameter portion of said cam ring track.

* * * * *